United States Patent [19]

Morey

[11] Patent Number: 5,005,620

[45] Date of Patent: Apr. 9, 1991

[54] DRUM-TYPE WOOD CHIPPER

[75] Inventor: Norval Morey, Winn, Mich.

[73] Assignee: Morbark Industries, Inc., Winn, Mich.

[21] Appl. No.: 510,086

[22] Filed: Apr. 17, 1990

[51] Int. Cl.[5] ..... B27L 11/00

[52] U.S. Cl. ..... 144/373; 144/162 R; 144/174; 241/92; 241/101.7

[58] Field of Search ..... 144/162 R, 172, 173, 144/174, 373; 241/37.5, 60, 92, 101.7, 189 R, 278 R, 298

[56] References Cited

U.S. PATENT DOCUMENTS

| | | | |
|---|---|---|---|
| 3,524,485 | 8/1970 | Smith . | |
| 3,661,192 | 5/1972 | Nicholson et al. | 144/172 |
| 3,861,602 | 1/1975 | Smith . | |
| 3,944,147 | 3/1976 | Pletcher . | |
| 3,989,198 | 11/1976 | Blasko . | |
| 4,057,192 | 11/1977 | Smith . | |
| 4,135,563 | 1/1979 | Maucher | 144/172 |
| 4,162,769 | 7/1979 | Lapointe | 144/174 |
| 4,260,114 | 4/1981 | Herder . | |

*Primary Examiner*—W. Donald Bray
*Attorney, Agent, or Firm*—Warner, Norcross & Judd

[57] ABSTRACT

A drum-type wood chipper having a chipper drum with knives mounted in openings with the drum wall. A chip basket is mounted within the drum behind each knife opening. The chipper knife is spaced from the drum wall at both the leading and trailing edges of the knife to define chip ingress and egress openings for the chip box. Cut chips pass into the chip box as the leading edge of the knife chips the infeed material; and the chips are carried by the box for subsequent discharge through the egress opening into a discharge chute.

22 Claims, 5 Drawing Sheets

DRUM-TYPE WOOD CHIPPER

BACKGROUND OF THE INVENTION

The present invention relates to wood chippers and more particularly to wood chippers having a rotatable drum carrying knives angularly spaced about its circumferential wall.

Wood chippers have been developed to reduce trees, limbs, branches, and the like to wood chips. Such chippers are typically used by municipalities and tree services. Chipping eliminates environmental problems associated with burning; and the chips can be used in a wide variety of applications such as mulch and fuel. Basically, the chippers are of two broad types.

The first and oldest style of chipper is the "drum-type" wherein the chipper knives are carried on the circumferential wall of a cylindrical drum. Typically, the drum is approximately 12 inches in diameter and carries 4 equally spaced knives about its perimeter. The drum is driven at 2500 to 3500 revolutions per minute (rpm) so that the machines make approximately 10,000 to 14,000 cuts per minute. with an average chip thickness of ¾ inch, the feed rate is 625 to 875 feet per minute. Such speeds are relatively fast and can be dangerous to operators feeding the chipper because, as the branches are pulled into the chipper, limbs can strike the workers. Further, the drum is typically a solid head with the knives clamped thereto. No space is provided for the chips. Accordingly, blowers or augers are included both to release the chips from the knives and to propel the chips through the chute. Engines with large horsepowers (i.e. in the range of 100 h.p. to 125 h.p.) are required to drive these chippers. Even with such engines, the drum chippers often stall. Further, the large engines require complicated and expensive emissions control equipment, especially in states such as California.

The second style of chipper is the "disc-type" wherein the knives are carried radially on the face of a spinning disc. An example of such a chipper is illustrated in U.S. Pat. No. 3,861,602 issued Jan. 21, 1975 to Smith and entitled Brush Chipper. The feed rates of disc-style chippers are significantly lower than those of drum-style chippers; and therefore the feed-speed problems are greatly alleviated. The distal end of the radially disposed knife travels at approximately 10,000 feet per minute, while the blade is traveling significantly slower towards the center of the disc. Consequently, chips removed at these different ends of the knife are travelling at different speeds and collide behind the disc and in the discharge chute to generally slow all of the chips down. Accordingly, the disc must be rotated faster than necessary to chip the wood to insure that the chips are properly discharged from the unit.

SUMMARY OF THE INVENTION

The aforementioned problems are overcome in the present invention wherein a drum-type chipper includes improved means for receiving wood chips from the chipper knives and propelling the chips into the discharge chute. Specifically, the peripheral wall of the drum defines a spaced pocket behind each knife. Both the leading and trailing edges of the knife are spaced from the peripheral wall to define ingress and egress openings for the pocket. As the drum rotates, the wood chips cut by the knife pass through the ingress opening and into the pocket behind the knife. The wood chip remains in the pocket until the drum rotates to the discharge chute. Under the influence of centrifugal force, the chip is expelled from the pocket through the egress opening and into the discharge chute.

The structure of the present invention maintains the speed and therefore momentum of the chip from the initial cut to the discharge chute. The chip is accelerated to the peripheral speed of the drum as the chip is cut from the infeed material. The drum of the present invention maintains the chip at that speed and releases the chip at that speed into the discharge chute. The cut chip never changes speed. By maintaining the momentum of all chips, the present chipper can operate with a significantly smaller power source than previous drum-style and even disc-style chippers.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
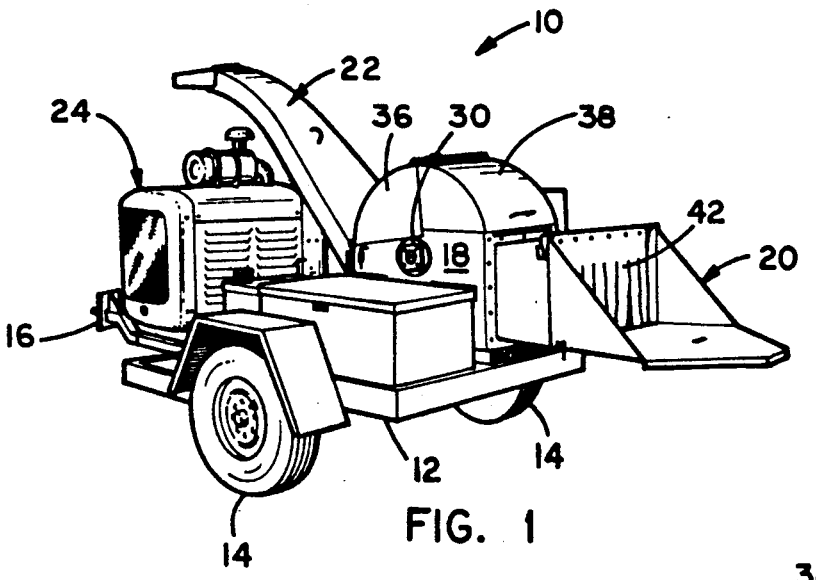
FIG. 1 is a perspective view of the left side of the wood chipper.
Figure 2:
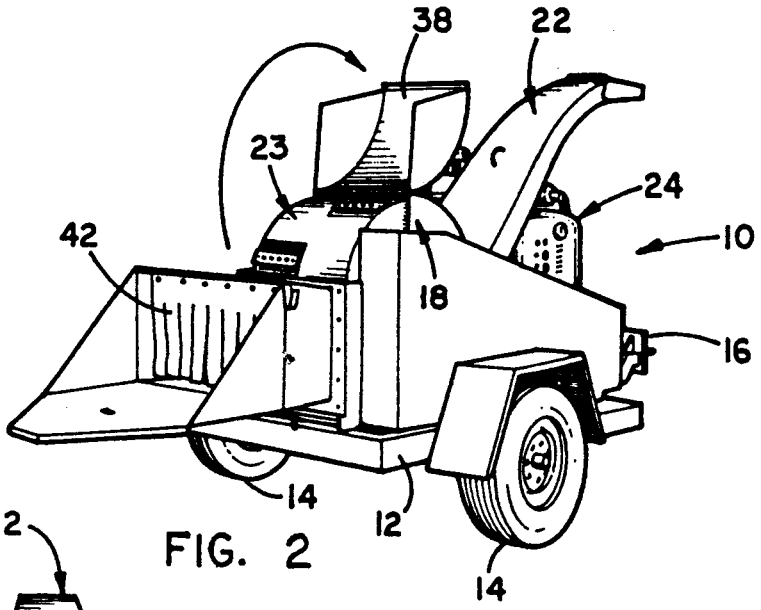
FIG. 2 is a perspective view of the right side of the wood chipper with the access door open.

The wood chipper of the present invention is generally illustrated in FIGS. 1–4 and designated 10. The chipper includes a frame 12 supported by a pair of wheels 14 and having a conventional hitch 16 for attachment to a vehicle. Supported on the frame 12 are a chipper housing 18, an infeed chute 20, and a discharge chute 22. A chipper drum 23 is rotatably supported within the housing 18 between the infeed and outfeed chutes 20 and 22. A power source 24, such as an internal combustion engine, is also mounted on the frame 12 to rotatably drive the chipper drum 23 using one or more v-belts (not shown).

The frame 12, wheels 14, and hitch 16 are of conventional construction. A tool box 25 is mounted on the frame 12 for storage of items such as chain saws and highway signs. The power plant 24 is a gasoline engine manufactured by Ford Motor Company of Dearborn, Mich. providing 60 h.p. In view of the relatively small power requirements of the chipper, the engine is smaller than is necessary with comparable capacity disc and drum chippers. For example, the present chipper requires only 50% of the power of a comparable capacity disc chipper and only 20% of the power of a comparable capacity drum chipper.

The housing 18, infeed chute 20, and outfeed chute 22 are also generally of conventional structure. The housing 18 encloses the chipper drum 23 to prevent people and objects from contacting the moving drum during chipping. The housing defines an infeed opening 32 and an outfeed opening 34 (see FIG. 4) and includes an upper stationary portion 36, an access door 38, and a belly-band 40. The stationary portion 36 and the access door 38 together cover the upper portion of the chipper drum between the infeed and outfeed openings. Similarly, the belly-band 40 extends under the lower portion of the chipper drum between the infeed and outfeed openings 32 and 34. The access door 38 extends the full length of the chipper drum 23 (see FIGS. 1–3) to provide full width access to the chipper drum when the door is open (see FIGS. 2 and 3).

The infeed chute 20 includes a curtain 42 of rubber flaps to catch chips and other debris possibly kicked back out of the infeed chute by the rotating chipper drum. The end portion 44 (see FIG. 4) of the infeed chute is hinged at point 46 to be pivotable upwardly into a travelling position, again as is conventional in the art. The infeed chute 20 further includes a stationary portion 48 which communicates with the infeed opening 32 to introduce material to be chipped to the chipper drum. Preferably, the infeed opening 32 extends only about the lower half of the chipper drum (i.e. below a horizontal plane through the axis) so that the knives are moving downwardly and/or forwardly (with respect to the trailer) as material is introduced into the chute. Such arrangement reduces the likelihood that chips will be propelled rearedly out of the infeed chute 20.

The discharge chute 22 communicates with the outfeed opening 34 of the drum housing 18 to receive chips to be discharged from the unit. The chute tapers in width from the discharge opening 34 to the spout 50 as perhaps best seen in Figs. 1 and 2. A pivotal deflector 52 is adjustable to direct chips into a vehicle.

The chipper drum 23 is rotatably supported within bearings 30 (FIG. 1) in conventional fashion for rotation about a generally horizontal axis as is generally well-known to those having ordinary skill in the art.

Whereas the components described thus far are generally conventional in the art, the chipper drum and its cooperation with the belly-band 40 are entirely novel with the present invention.

Figure 3:
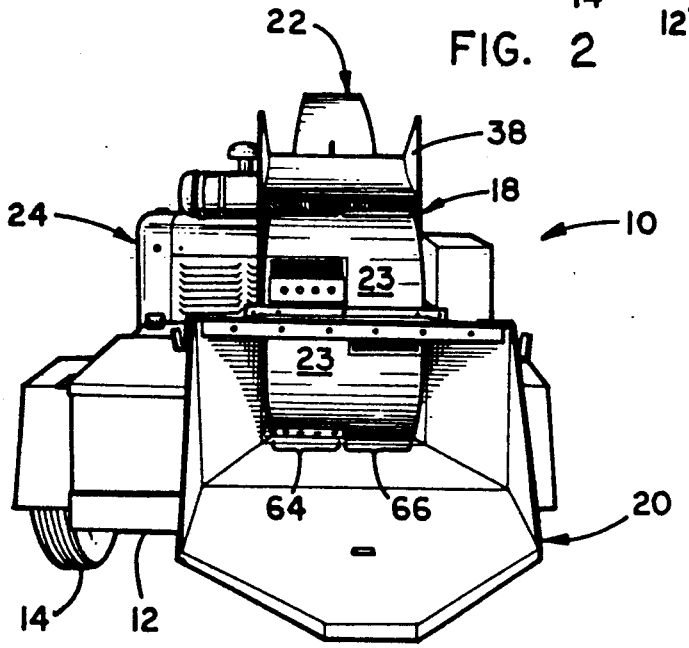
FIG. 3 is a perspective view of the rear of the wood chipper.
Figure 4:
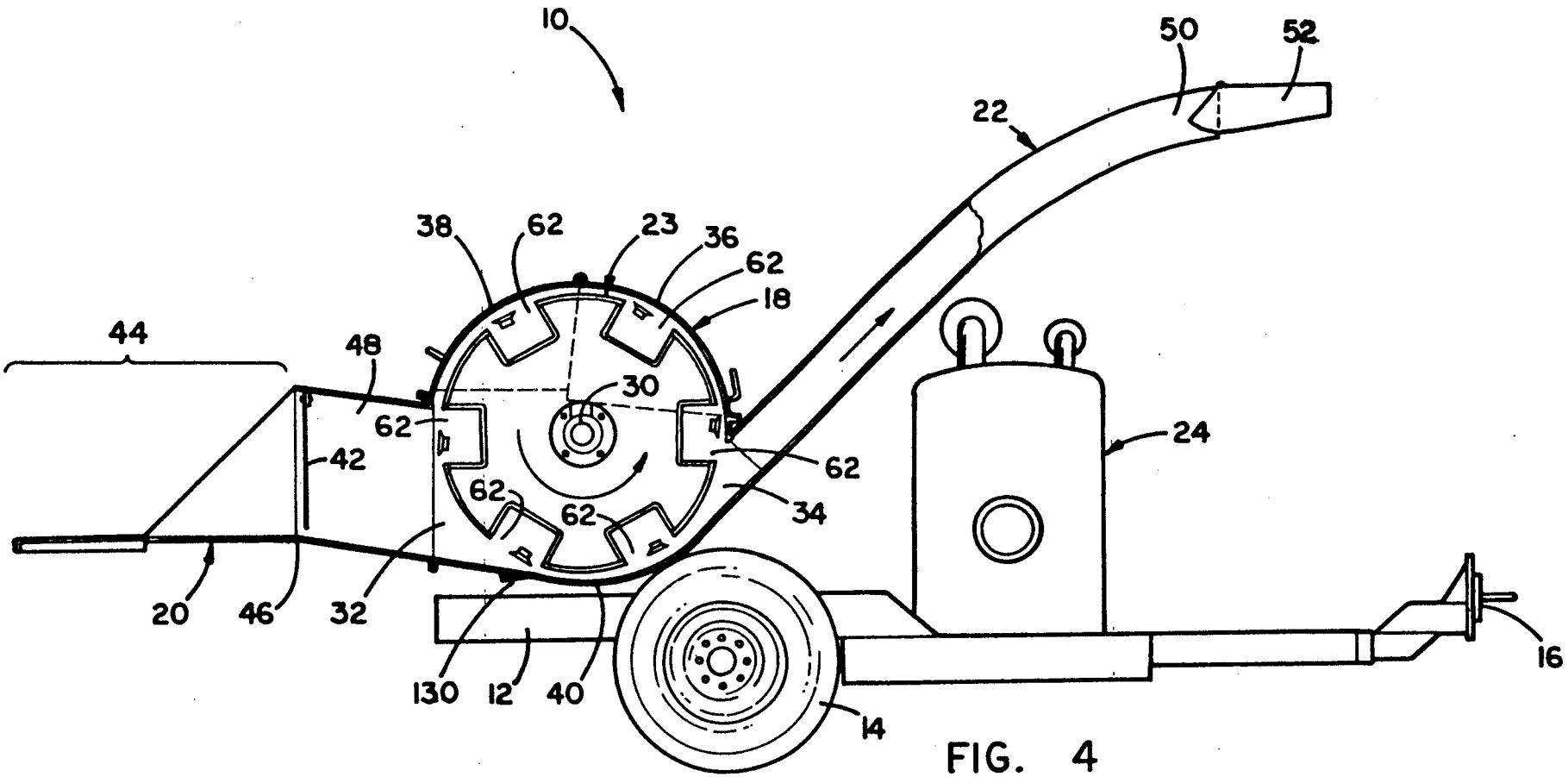
FIG. 4 is a schematic diagram, partially in section, of the wood chipper.
Figure 7:
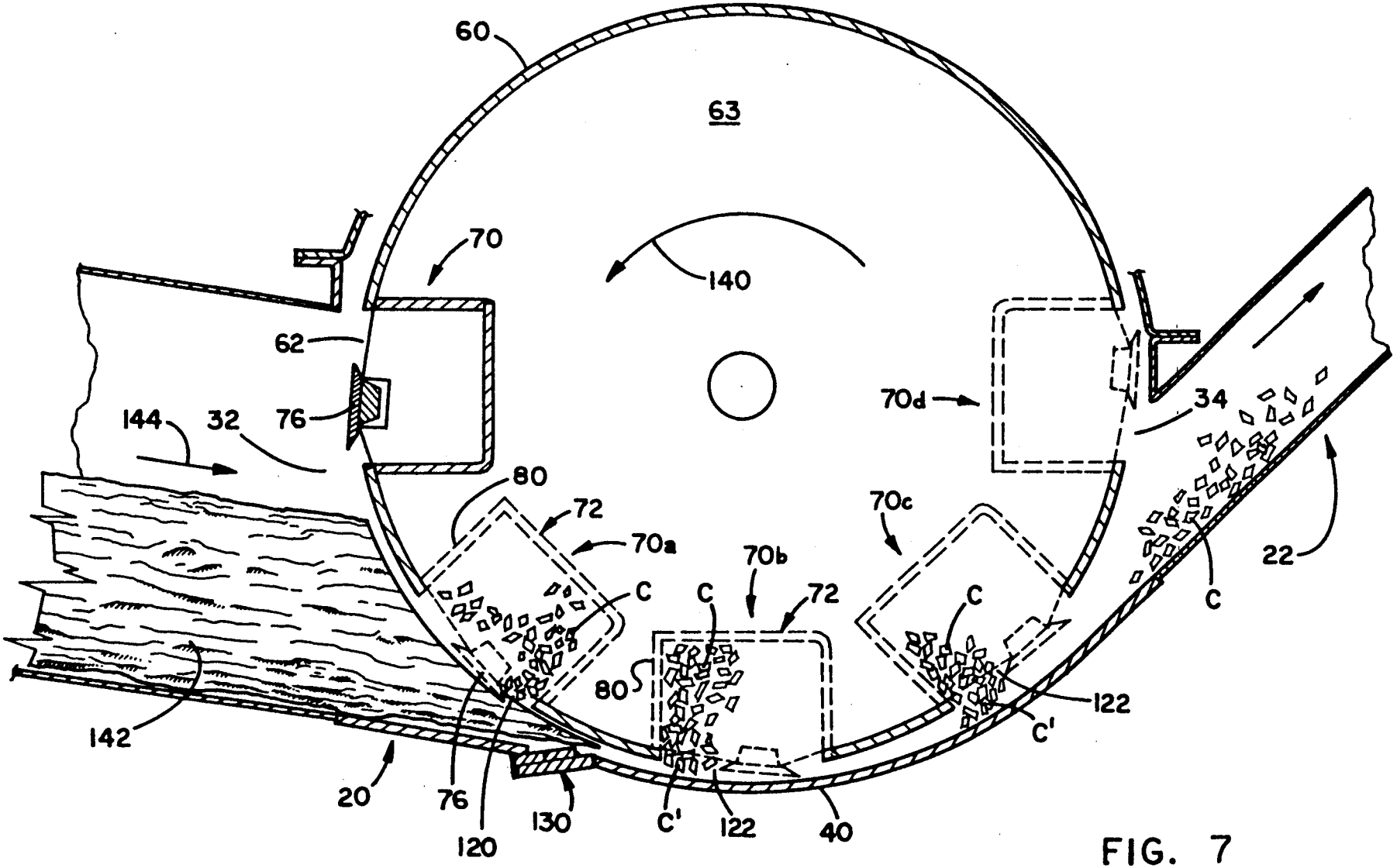
FIG. 7 is a sectional view of the chipper drum, with various stages of the knife pocket shown in phantom.

As illustrated in FIGS. 4 and 7, the chipper drum includes a cylindrical or peripheral wall 60 which defines a plurality of spaced openings 62 about its circumference. In the preferred embodiment, the drum is 36 inches in diameter and fabricated of ½-inch steel pipe. A pair of end plates 63 are secured to and close the opposite ends of the drum. The bearings 30 support the end plates and drum for rotation. The drum includes two conceptual halves 64 and 66 (see FIG. 3) separated by an imaginary diametrical plane. Each half includes three equiangularly spaced pockets oriented 120° apart about the circumference. The pockets on the drum halves are not longitudinally aligned, but rather each pocket is equally spaced from the nearest pockets on the adjacent drum half.

Figure 5:
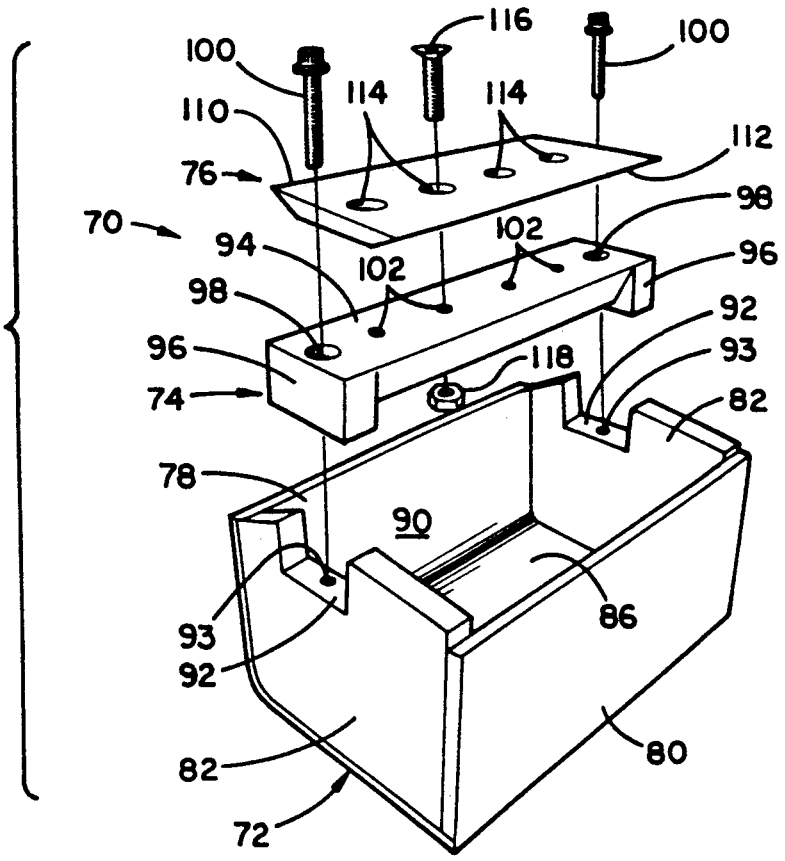
FIG. 5 is an exploded perspective view of the knife and chip pocket assembly.
Figure 6:
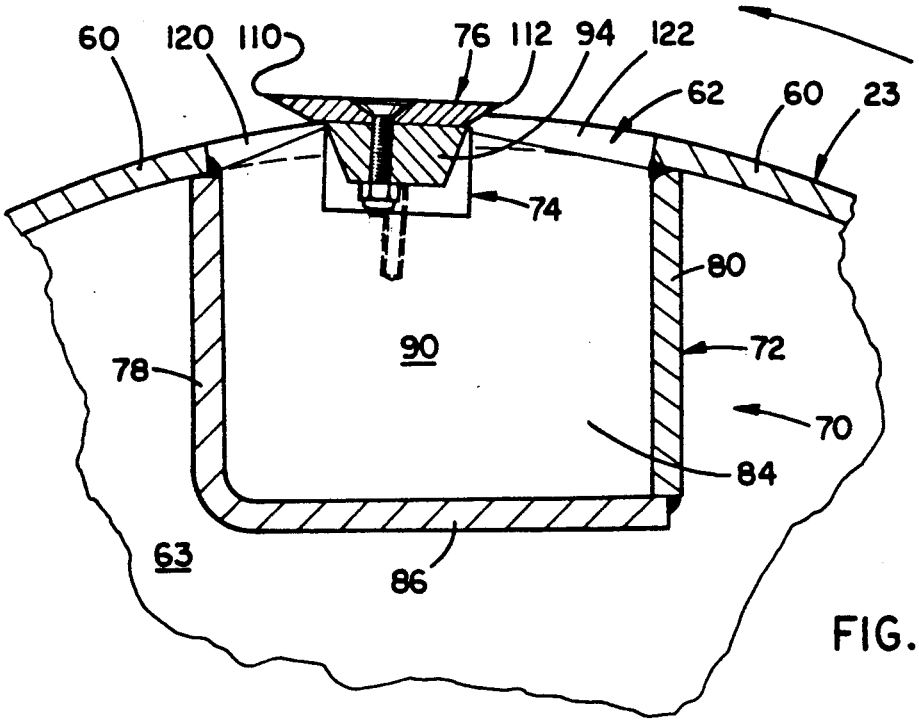
FIG. 6 is a sectional view of the knife and chip pocket assembly mounted in the drum.

The basket and knife assembly 70 mounted within each opening in the drum is illustrated in FIGS. 5 and 6 and generally designated 70. The assembly includes a basket or chip box 72, a knife holder 74, and a knife 76.

The chip box 72 (FIGS. 5 and 6) includes a front wall 78, a rear wall 80, and a pair of opposite side walls 82. A floor 86 is integral with and perpendicular to the front wall 78. The walls 78, 80, and 82 and the floor 86 together define a chip-receiving chamber 90 aligned with the drum opening 62. The front wall/floor 78/86 is fabricated of ⅜-inch steel. The side walls 82 are 1-inch steel, and the rear wall 80 is ⅜-inch T-1 steel. All of the chip box components are welded together to form a rigid structure.

The upper edges (as viewed in FIGS. 5 and 6) of the walls 78, 80, and 82 define an open end for the chip chamber 90 which generally coincides with the drum opening 62. A generally rectangular knife holder pocket 92 opens through the upper edge of each of the side walls 82 and 84 to receive the knife holder as will be described. A threaded bore 93 is positioned in the bottom of each pocket 92. The upper edges of the side walls 82 and 84 slope downwardly (again as viewed in FIGS. 5 and 6) from the knife holder pockets 92 to accommodate the curvature of the drum 23.

The upper edges of the chip box walls 78, 80, and 82 coincide with and are welded to the perimeter of the drum opening 2. Accordingly, the chip box forms an enclosure for chips so that all chips entering and leaving the box must pass through the drum opening.

The knife holder 74 extends the full width of the chip box 72. The holder includes a central body portion 94 having a pair of opposite ends or feet 96. The knife holder body 94 is generally trapezoidal in cross-section (see particularly FIG. 6) to facilitate the movement of chips into and out of the chip box as will be described. The feet 96 at the opposite ends of the knife holder are generally rectangular in cross-section and are dimensioned to be closely received within the knife holder pockets 92 in the side walls 82 and 84. The feet 96 each define a throughbore 98 generally aligned with the threaded bore 93 in the pockets 92. Bolts 100 extend through the bores 98 and into the threaded bores 93 to secure the knife holder in position. A plurality, preferably four, of through bores 102 also extend through the knife holder body for attachment of the knife as will be described.

The chipper knife 76 is generally well-known to those having ordinary skill in the chipper art. Specifically, the knife is a generally planar member having a pair of opposite edges 110 and 112. The chipper knife 76 defines a plurality of counter-sunk bores 114 aligned with the through bores 102 in the knife holder 74. Bolts 116 (only one shown) extend through the aligned bores 102 and 114 and are secured using nuts 118 to retain the knife on the knife holder. The edge 110 of the knife so mounted is referred to as the cutting or leading edge; while the edge 112 is referred to as the trailing edge. In actuality, both of edges 110 and 112 are sharpened to provide cutting edges. After the knife has been used in one orientation, the edge will become dull; and the knife can be removed and turned end-for-end so that the opposite edge may be used. However, for clarity in discussing the remainder of the structure, the edges 110 and 112 will be referred to as cutting and trailing edges, respectively.

When mounted as described, the leading edge 110 of the knife 76 is positioned ¾ inch above the drum wall 60 to cut ¾-inch chips. Shims (not shown) can be placed in pockets 92 under feet 96 to increase the height of the knives and thereby increase the size of the chips. Such structure greatly facilitates and simplifies adjustment of the knives.

As perhaps best illustrated in FIG. 6, the leading and trailing edges 110 and 112 are spaced from the drum wall 60. Specifically, the trailing edge 110 is spaced from the drum wall 60 to define a chip ingress opening 120; and the trailing edge 112 is spaced from the drum wall 60 to define a chip egress opening 122. As will be described, cut chips enter the chip box 90 through the ingress opening 120; and the chips are subsequently expelled through the chip egress opening 122 into the discharge chute 22.

An anvil 130 (see particularly FIG. 7) is mounted intermediate the infeed chute 20 and the belly-band 40. Anvil 130 extends the full length of the chipper drum and is generally well known to those having ordinary skill in the chipper art. The clearance between the knives and the chipper drum in the preferred embodiment is in the range of 10 to 20 thousandths of an inch. The spacing between the knives and the belly-band 40 immediately adjacent the anvil 130 is on the order of ⅛ inch; and the spacing of the belly-band from the chipper knives in the area of the discharge chute 22 is approximately one inch. This enlarging space between the anvil and the discharge chute insures that chips will not be caught, wedged, or otherwise lodged between the chipper drum and the belly-band.

OPERATION

The chipper is connected to a service vehicle using the hitch 16 for towing to the work site. As is conventional in the art, the towing vehicle will typically include a compartment for receiving the chips from the discharge chute 22.

At the site, the power plant or engine 24 is started and preferably brought to a warm idle speed. A conventional clutch (not shown) is then engaged to begin driving the drum 23. When the clutch is fully engaged, the speed of the engine 24 is increased to bring the drum 23 to approximately 600 r.p.m. This speed will produce an infeed rate of 112.5 feet per minute and a chip velocity of 5650 feet per minute. At this point, the chipper 10 is ready to receive material to be chipped.

FIG. 7 best illustrates the operation of the chipper. A single chip basket and knife assembly 70 is illustrated in a first position and in four subsequent positions **70*a*, 70*b*, 70*c*, and 70*d*. The drum rotates in the direction of arrow 140 so that the knife 76 is moving downwardly and forwardly in the area of the infeed opening 32**. This orientation reduces chip kick-back and pulls the material forwardly so that additional feed mechanisms are unnecessary.

The material 142 to be chipped is introduced to the drum chipper through the chute 20. The material 142 lifts the rubber flap curtain 42 (see FIG. 4) as the material is forced through the chute. The feed direction of the material is indicated by the arrow 144.

The chipper knife 76 is illustrated in a position just prior to engaging the material 142. The chipper knife 76 then moves downwardly through and along the material 142 as illustrated in position **70*a*. As the chips C are cut by the knife 76, the chips pass through the ingress opening 120 into the chip box 72. In view of the relatively high velocity of the chipper drum, the chips tend to travel to the rear wall 80 and accumulate there. At the end of the cutting area, the knife 76 passes the anvil 130** to complete the cutting action.

The position **70*b* of the knife assembly shows the orientation of the chips C upon the completion of the cutting stroke. Specifically, the chips C accumulate against the rear wall 80 of the pocket. Because the cut chips travel with the rotating drum, the chips are accelerated to the linear speed of the peripheral portion of the drum as they are carried by the pockets. As also seen in position 70*b*, the centrifugal force of the rotating drum begins expelling the chips radially outwardly; and some chips C′ will begin riding along the belly-band 40**.

The next position **70*c* of the assembly illustrates the position of the chips C as they continue to move under the influence of the centrifugal force. A greater proportion of the chips C′ now rides along the belly-band 40 as they are expelled through the egress or discharge opening 122**.

As the assembly 70 continues to rotate past the discharge opening 34, the chips C are propelled into the discharge chute 22 under the centrifugal force. The chips have more than enough velocity and momentum to be easily carried along the length of the chute 22 and into the collective vehicle. Blowers and/or augers are unnecessary. Finally, the assembly rotates to the position **70*d*** wherein all chips have been expelled therefrom.

As previously described, three chip pocket and knife assemblies 70 are equiangularly spaced about each drum segment 64 and 66 (see also FIG. 3). By staggering the knives in the two-drum segments, the chipping force is more evenly distributed about the periphery of the drum. Stated another way, six half-cuts distribute the forces more evenly than would three full cuts.

As most clearly seen in FIG. 7, the drum chipper of the present invention immediately accelerates the cut chips to the tangential speed of the drum and maintains the chip speed into the discharge chute. Consequently, the momentum of the chips need not be changed or redirected during the chipping and expulsion sequence. This eliminates the need for fans, augers, and other prior art chip-moving devices.

ALTERNATE EMBODIMENT

Figure 8:
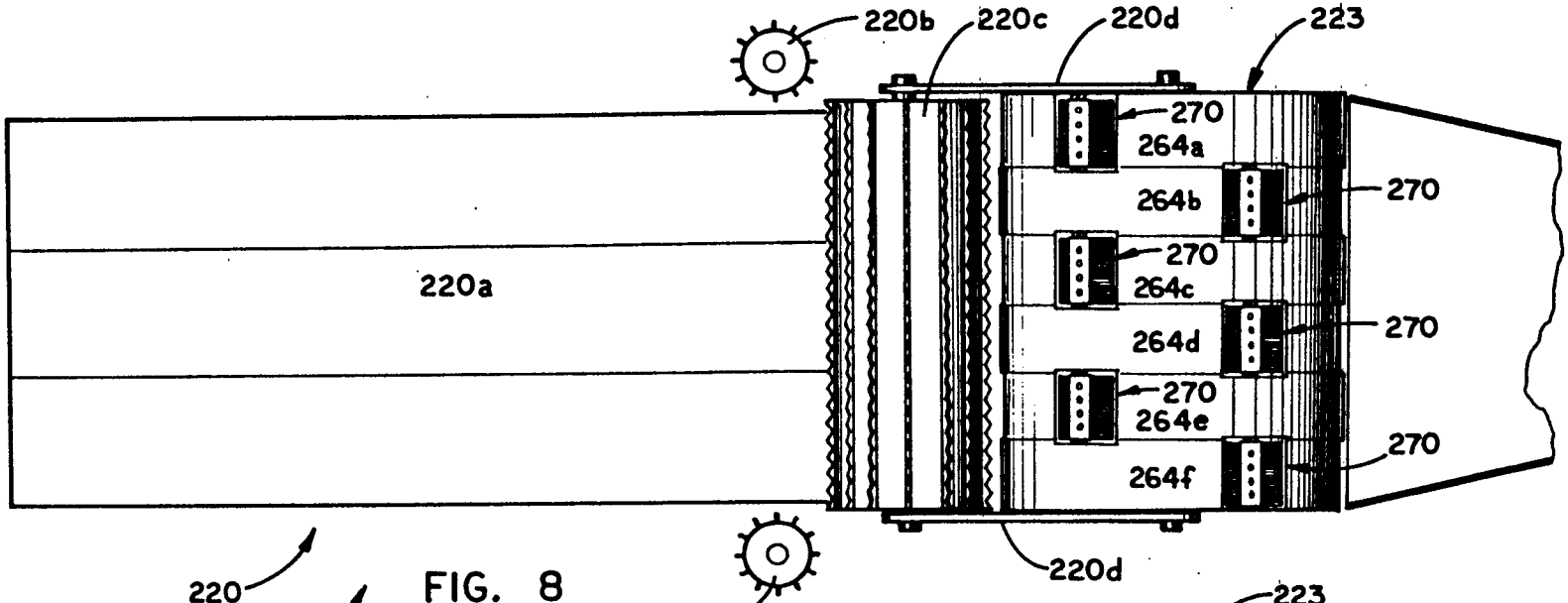
FIG. 8 is a top plan view of an alternate embodiment of the invention showing a wide chipper drum and a powered infeed assembly.
Figure 9:
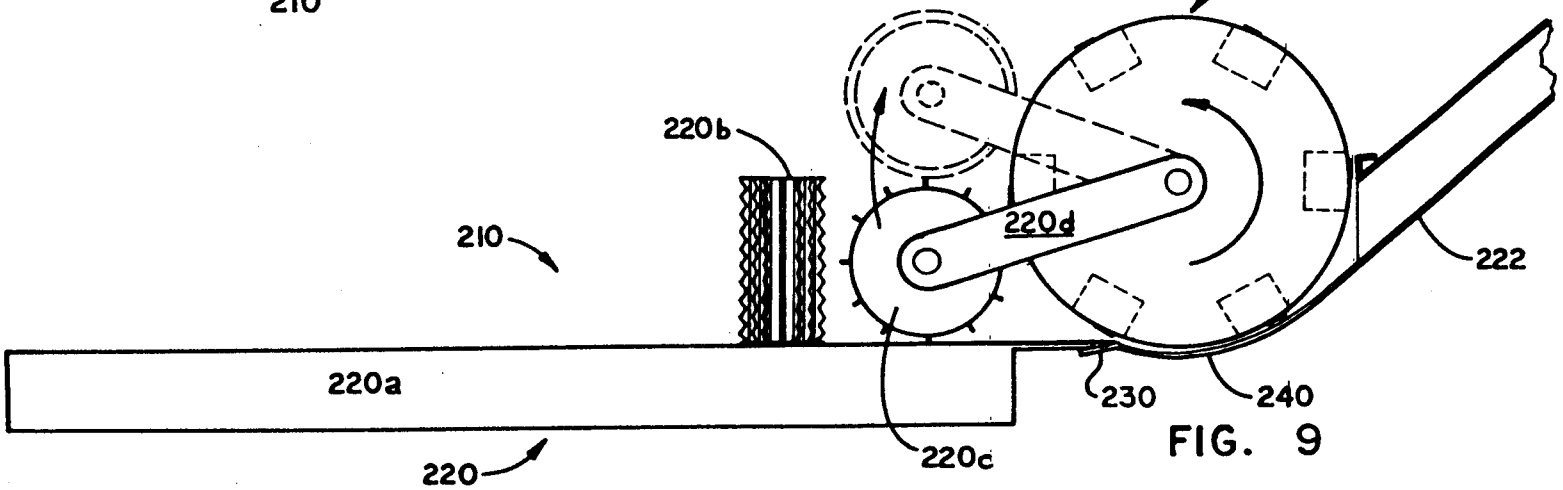
FIG. 9 is a side elevational view of the alternate embodiment.

An alternate embodiment of the invention is illustrated in FIGS. 8 and 9 and generally designated 210. The alternate chipper is only schematically illustrated since it has not yet been prototyped. Generally speaking, the alternate chipper 210 includes an infeed system 122, a discharge chute 222, and a chipper drum 223.

The infeed system 220 includes a chain conveyor **220*a*, a pair of powered side rollers 220*b* and a powered top roller 220*c*. All of these components are powered in a direction to feed brushy material to the drum 223. The powered top roller 220*c* is swingably mounted on arms 220*d*** to accommodate the varying heights of the brushy material to be introduced to the chipper drum.

The chipper drum 223 is the logical extension of the previously described chipper drum 23. The only difference is that the chipper drum 223 is longer than the chipper drum 23 and includes six segments **264*a*, 264*b*, 264*c*, 264*d*, 264*e*, and 264*f*. Each of the drum segments includes three knife and pocket assemblies 270 mounted about its periphery. The assemblies 270 and adjacent drum segments 264 are staggered so that the assemblies of any drum segment 264 are not longitudinally aligned with the assemblies 270** of either adjacent segment. The drum construction technique of the present invention can be used to fabricate a drum of any desired length.

The anvil 230, belly-band 240, and discharge chute 222 are generally identical to those described in the previous embodiment with the exception of the increased width to accommodate the drum length. The chipping and discharge functions are exactly as previously described.

The above descriptions are those of preferred embodiments of the invention. Various alterations and changes can be made without departing from the spirit and broader aspects of the invention as defined in the appended claims which are to be interpreted in accordance with the principles of patent law, including the doctrine of equivalents.

The embodiments of the invention in which an exclusive property or privilege is claimed are defined as follows:

1. A wood chipper for reducing trees, limbs, branches, and the like to wood chips, and chipper comprising:

a rotatable drum including a circumferential wall portion carrying at least one knife, said knife including a cutting edge and a trailing edge, said circumferential wall portion defining cutting and trailing openings adjacent said cutting and trailing edges through which wood chips may freely pass, said drum further including chip retainer means under said knife and spanning said cutter and trailing openings for receiving wood chips passing through said cutting openings and for temporarily retaining and carrying the chips for discharge through said trailing opening under centrifugal force;

an infeed chute for guiding materials to be chipped to said circumferential portion of said drum to be chipped by said knife;

a discharge chute for guiding chips from said drum following discharge from said chip retainer means.

2. A wood chipper as defined in claim 1 further comprising a housing between said infeed chute and said discharge chute for preventing chips from leaving said basket prior to arrival at said discharge chute.

3. A wood chipper as defined in claim 1 wherein said circumferential wall portion is uninterrupted except for said cutting and trailing openings.

4. A wood chipper as defined in claim 1 wherein said drum carries a plurality of said knives and defines a cutting and trailing opening associated with each said knife.

5. A wood chipper as defined in claim 4 wherein said drum includes two drum segments separated by a diametrical plane, each of said drum segments including a plurality of knives spaced around its periphery, said knives in adjacent drum segments being angular offset so as to be unaligned longitudinally.

6. A wood chipper as defined in claim 1 further comprising a housing enclosing said chipper drum, said housing including an access door extending the full length of said drum adjacent an upper portion of said drum to permit ready access to said drum for servicing of said knives.

7. A wood chipper as defined in claim 1 wherein said infeed chute includes powered conveyor means for carrying material to be chipped to said drum.

8. An improved drum-type wood chipper including an infeed chute, a rotating drum assembly carrying knives, and an outfeed chute, wherein the improvement comprises said drum assembly comprising:

a drum having a circumferential wall defining at least one opening;

a knife supported by said drum over said opening; and basket means spanning said opening for receiving wood chips passing through said opening and for holding the wood chips for subsequent passage of the wood chips through said opening under centrifugal force.

9. An improved chipper as defined in claim 8 wherein said assembly further comprises a housing closely adjacent said circumferential wall of said drum between said infeed chute and said outfeed chute to prevent chips from exiting said basket means between said chutes.

10. An improved chipper as defined in claim 8 further comprising a plurality of knives angularly spaced about said circumferential drum wall.

11. A wood chipper comprising:

a frame;

a chipper drum rotatably supported on said frame for rotation about a horizontal axis, said chipper drum including a circumferential wall defining a plurality of angularly spaced openings, said chipper drum further including a knife mounted within each of said openings and having a cutting edge oriented in the direction of rotation of the drum and a trailing edge, said knife being narrower than the opening and located within the opening to define spaces between each of said cutting and trailing edges and said circumferential wall through which wood chips may pass, said chipper drum further including a basket extending from said circumferential wall into said drum about said opening, whereby chips cut by said knife cutting edge pass through said space adjacent said cutting edge and into said basket for subsequent expulsion from said basket through said space adjacent said trailing edge;

motive means for rotating said chipper drum;

infeed chute means for directing material to be chipped to said chipper drum;

outfeed chute means for guiding chips away from said drum; and a housing including retention means between said infeed chute means and said outfeed chute means for retaining chips within baskets between said infeed and outfeed chute means.

12. A wood chipper as defined in claim 11 wherein said circumferential wall is uninterrupted except for said openings.

13. A wood chipper as defined in claim 11 wherein:

each of said openings and knives extends less than the full length of said drum; and knives in adjacent longitudinal segments of said drum are unaligned so as to be angularly staggered.

14. A wood chipper as defined in claim 11 wherein said housing further includes a hinged access door extending the full length of said drum providing access to the upper portion of said drum for knife maintenance.

15. A knife assembly for a drum-type wood chipper comprising:

a chip box including forward, rear, and two side walls and a bottom defining a chip chamber, said walls having upper edges together defining an open top for said chip chamber, said side walls further defining two pockets opening through said upper edges of said side walls;

a knife holder including a body portion for supporting a knife and a pair of feet closely received within said pockets to support said knife holder on said chip box, said body portion being spaced from both said forward and rear box walls; and a knife secured to said knife holder body portion, said knife having a leading edge spaced from said forward box side and a trailing edge spaced from said rear box side.

16. A wood chipper for reducing trees, limbs, branches, and the like to wood chips, and chipper comprising:

a rotatable drum including a circumferential portion carrying a plurality of knives, said knives each including a cutting edge and a trailing edge, said circumferential portion defining cutting and trailing openings adjacent said cutting and trailing edges through which wood chips may freely pass, said drum further including chip retainer means under said knife and spanning said cutting and trailing openings for receiving wood chips passing through said cutting opening and for retaining the chips for discharge through said trailing opening under centrifugal force, said drum further including two drum segments separated by a diametrical plane, each of said drum segments including a plurality of knives spaced around its periphery, said knives in adjacent drum segments being angularly offset so as to be unaligned longitudinally;

an infeed chute for guiding materials to be chipped to said circumferential portion of said drum to be chipped by said knife;

a discharge chute for guiding chips from said drum following discharge from said chip retainer means.

17. In a wood chipper for reducing wood products to wood chips, said chipper comprising:

a. A chipper housing having an inlet for receiving material to be chipped and an outlet for chips;

b. A chipper drum mounted within said housing between said inlet and outlet and having a perimetral portion;

c. means mounting said drum for rotation in said housing in a wood chipping direction of travel about an axis;

d. said drum having at least one knife mounted on said perimetral portion of the drum, the knife having a generally tangential portion with a cutting edge, disposed forwardly with respect to sasid direction of rotation at a spaced radial distance outwardly from the said perimetral portion;

e. means for driving the drum and knife in said rotary direction of travel;

f. an anvil mounted by the housing radially adjacent the rotary path of travel of said cutting edge of said knife to cooperate with said knife in cutting chips;

g. said perimetral portion of the drum having a chip inlet opening forwardly of the adjacent said knife cutting edge for passing chips cut by said knife, and a chip retention basket radially inward of the knife in communication with said drum inlet opening for receiving and circumferentially transporting the chips cut;

h. said drum also having a chip outlet opening rearwardly of said knife cutting edge and communicating with said basket; and said housing having a curvilinear belly band means between said anvil and chipper housing outlet conforming in shape generally to the path of rotation of said cutting edge and spaced radially outwardly thereof and said basket a distance to retain chips in said basket as the basket travels forwardly of the anvil along said belly band means toward said chipper housing outlet so as to accelerate the chips to the speed of rotation of said drum and hurl them through said chipper housing outlet.

18. A wood chipper as defined in claim 17 wherein an upwardly directed chip discharge chute extends from said chipper housing outlet to direct and discharge chips hurled through said outlet.

19. A wood chipper as defined in claim 17 wherein a wood material infeed support member leads to said chipper housing inlet and said anvil is generally in planar alignment therewith.

20. A wood chipper as defined in claim 17 wherein a generally horizontal wood material infeed support member leads toward said chipper housing inlet and a powered feed roller is provided above said infeed support member, said means mounting said drum for rotation including a shaft having an axis of rotation and said feed roller being supported for up and down swinging movement adjacent said chipper housing on arms pivotally supported to swing substantially about said shaft axis of rotation.

21. A chipper as defined in claim 17 wherein said perimetral portion comprises a cylindrical wall portion mounting a plurality of circumferentially spaced knives with a chip retention basket for each knife, said cylindrical wall portion being uninterrupted except for chip inlet openings leading to each basket and chip outlet openings communicating with each basket, and said baskets being closed except for communication with said chip inlet and chip outlet openings.

22. In a method of using a wood chipper for reducing wood products to wood chips, the chipper having:

a chipper housing with an inlet for receiving material to be chipped and an outlet for chips, a chipper drum mounted within the housing between the inlet and outlet and having a perimetral portion, at least one knife mounted on the perimetral portion of the drum, mechanism mounting the drum and knife for rotation in the housing and driving it in a chipping direction of rotation, the knife having a generally tangential portion with a cutting edge disposed forwardly with respect to said direction of drum and knife rotation, an anvil mounted by the housing radially adjacent the rotary path of travel of the knife cutting edge to cooperate with the knife in cutting chips, the perimetral portion of the drum having a chip inlet opening forwardly of and adjacent the knife cutting edge for passing chips cut by the knife and a chip retention basket radially inward of the knife in communication with the drum chip inlet opening for receiving and circumferentially transporting the chips cut, the drum also having a chip outlet opening rearwardly of the knife cutting edge and communicating with the basket, and the housing having a curvilinear belly band between the anvil and chipper housing outlet conforming in shape generally to the path of rotation of the cutting edge and spaced radially outwardly thereof and the basket a distance to retain chips in the basket, the steps of:

a. feeding wood material to said chipper housing inlet and into the path of rotation of said knife to chip the inner end portions of said wood materials;

b. collecting the chips cut by said knife in said basket and retaining them therein against the operation of centrifugal force by substantially blocking their free outward egress through sasid drum outlet opening by passing said basket along said retaining belly band in its path to said chipper housing outlet to cause the chips to accelerate to the speed of rotation of said drum; and c. hurling them through said chipper housing outlet.

* * * * *

UNITED STATES PATENT AND TRADEMARK OFFICE

CERTIFICATE OF CORRECTION

PATENT NO. : 5,005,620

DATED : April 9, 1991

INVENTOR(S) : Morey

It is certified that error appears in the above-identified patent and that said Letters Patent is hereby corrected as shown below:

Column 7, Claim 1, Line 12:
second "and" should be --said--

Column 7, Claim 1, Line 23:
"openings" should be --opening--

Column 9, Claim 16, Line 4:
second "and" should be --said--

Column 9, Claim 17, Line 40:
"sasid" should be --said--

Column 9, Claim 17, Line 48:
"the" should be --and--

Column 9, Claim 17, Line 57:
before "said" insert --i.--

Column 10, Claim 22, Line 61:
"sasid" should be --said--

Signed and Sealed this

Second Day of February, 1993

*Attest:*

STEPHEN G. KUNIN

*Attesting Officer*

*Acting Commissioner of Patents and Trademarks*